US008052380B2

(12) United States Patent
Willett, Jr.

(10) Patent No.: US 8,052,380 B2
(45) Date of Patent: Nov. 8, 2011

(54) THERMALLY-ACTIVATED CLEARANCE REDUCTION FOR A STEAM TURBINE

(75) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 12/260,548

(22) Filed: Oct. 29, 2008

(65) Prior Publication Data

US 2010/0104416 A1 Apr. 29, 2010

(51) Int. Cl.
*F01D 5/20* (2006.01)
*F01D 11/08* (2006.01)

(52) U.S. Cl. ..... 415/173.5; 415/173.3; 415/114; 415/134

(58) Field of Classification Search ..... 415/114, 415/134, 139, 173.3, 173.5, 173.6, 170.1, 415/174.5
See application file for complete search history.

(56) References Cited

U.S. PATENT DOCUMENTS

| | | | | |
|---|---|---|---|---|
| 5,098,257 | A * | 3/1992 | Hultgren et al. | 415/115 |
| 5,234,318 | A * | 8/1993 | Brandon | 416/192 |
| 5,333,993 | A * | 8/1994 | Stueber et al. | 415/174.5 |
| 5,601,402 | A | 2/1997 | Wakeman et al. | |
| 6,406,256 | B1 * | 6/2002 | Marx | 415/138 |
| 6,463,729 | B2 * | 10/2002 | Magoshi et al. | 60/39.182 |
| 6,926,495 | B2 | 8/2005 | Diakunchak | |
| 7,287,956 | B2 | 10/2007 | Bracken et al. | |
| 2008/0169616 | A1 | 7/2008 | Awtar et al. | |
| 2010/0104416 | A1 | 4/2010 | Willett, Jr. | |
| 2010/0104427 | A1 * | 4/2010 | Willett, Jr. | 415/173.1 |

OTHER PUBLICATIONS

Blum, Notice of Allowance and Fee(s) Due for U.S. Appl. No. 12/260,573 dated Aug. 3, 2011, 13 pages.

* cited by examiner

*Primary Examiner* — David Nhu
(74) *Attorney, Agent, or Firm* — Hoffman Warnick LLC; Ernest G. Cusick

(57) ABSTRACT

A thermally-activated flow clearance reduction for a steam turbine is disclosed. In one embodiment a gap closure component is located about a rotary component and a stationary component of the steam turbine. A temperature differential activates the gap closure component to seal or reduce the radial clearance of the steam flow path between the rotary component and the stationary component.

20 Claims, 5 Drawing Sheets

THERMALLY-ACTIVATED CLEARANCE REDUCTION FOR A STEAM TURBINE

CROSS REFERENCE TO RELATED APPLICATIONS

This patent application relates to commonly-assigned U.S. patent application Ser. No. 12/260,573 entitled "PRESSURE ACTIVATED FLOW PATH SEAL FOR A STEAM TURBINE", filed concurrently with this application.

BACKGROUND OF THE INVENTION

The present invention relates generally to seals between rotatary and stationary components of a steam turbine and more particularly to a seal or clearance reducer activated by a temperature differential formed in the stationary component as the turbine transitions from an inactive condition to a steady-state operation.

In a steam turbine, a seal between rotary and stationary components is an important part of the steam turbine performance. It will be appreciated that the greater the number and magnitude of steam leakage paths, the greater the losses of efficiency of the steam turbine. For example, labyrinth seal teeth often used to seal between the diaphragms of the stationary component and the rotor or between the rotor bucket tips and the stationary shroud of the rotary component require substantial clearances to be maintained to allow for radial and circumferential movement during transient operations such as startup and shutdown of the steam turbine. These clearances are, of course, detrimental to sealing. There are also clearance issues associated with multiple independent seal surfaces, tolerance stack up of radial clearances and assembly of multiple seals, all of which can diminish steam turbine efficiency. Moreover, it is often difficult to create seals which not only increase the efficiency of the steam turbine but also increase the ability to service and repair various parts of the turbine as well as to create known repeatable boundary conditions for such parts.

BRIEF DESCRIPTION OF THE INVENTION

In one aspect of the present invention, a steam turbine is provided. The steam turbine comprises a rotary component including a plurality of circumferentially spaced buckets that are spaced at axial positions. Each of the plurality of buckets has a tip with an adjacent cover that includes one or more seal teeth. The steam turbine further comprises a stationary component that includes a plurality of diaphragms that each has a diaphragm outer ring. The plurality of diaphragms are axially positioned between adjacent rows of the plurality of buckets. Each row forms a turbine stage that defines a portion of a steam flow path through the turbine. Each diaphragm outer ring has at least one groove formed therein. The steam turbine further comprises a gap closure component located about the rotary component and the stationary component that seals a portion of a steam leakage path. The gap closure component includes a plurality of gap closure devices. Each of the plurality of gap closure devices is located in the at least one groove of a respective diaphragm outer ring and about the one or more seal teeth of a respective bucket cover in a turbine stage. Each of the plurality of gap closure devices is activated by a temperature differential formed in the diaphragm outer ring as the turbine transitions from an inactive condition to a steady-state operation. Each of the plurality of gap closure devices provides a seal of the steam leakage path through the one or more seal teeth of the bucket cover and the diaphragm outer ring in response to being activated.

DETAILED DESCRIPTION OF THE INVENTION

Figure 1:
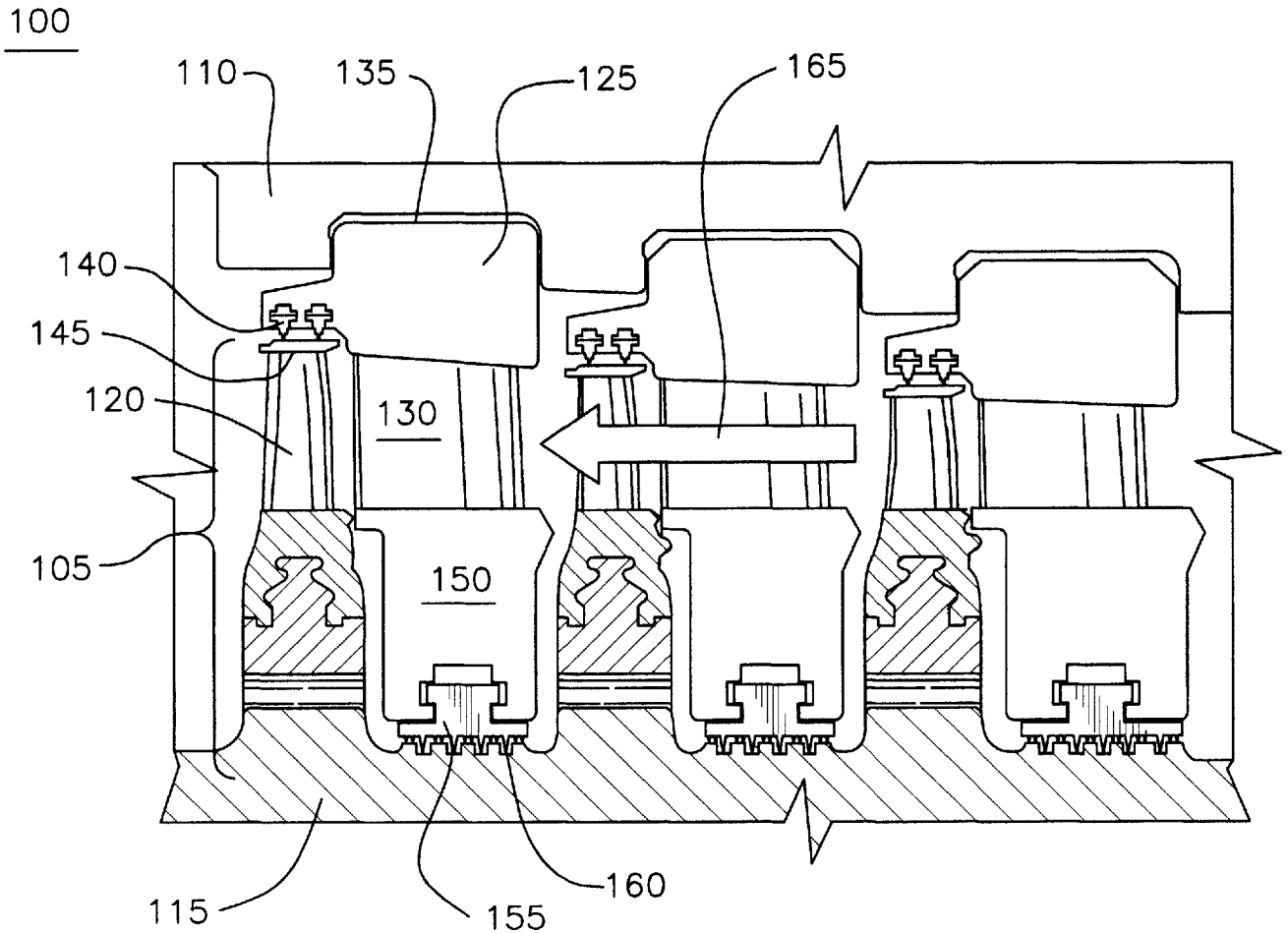
FIG. 1 (PRIOR ART)
FIG. 1 is a fragmentary cross-sectional view of a portion of a steam turbine illustrating various seals according to the prior art.

Referring now to the figures, particularly to FIG. 1, there is illustrated a portion of a steam turbine 100 having a rotary component 105 and a stationary component 110. Rotary component 105 includes, for example a rotor 115 mounting a plurality of circumferentially spaced buckets 120 at spaced axial positions along the turbine forming parts of the various turbine stages. Stationary component 110 including a plurality of diaphragms 125 mounting partitions 130 defining nozzles which, together with respective buckets, form the various stages of steam turbine 100. As illustrated in FIG. 1, an outer ring 135 of the diaphragm 125 carries one or more rows of seal teeth 140 for sealing with shrouds or covers 145 adjacent the tips of buckets 120. Similarly, an inner ring 150 of diaphragm 125 mounts an arcuate seal segment 155. The seal segment has radially inwardly projecting high-low teeth 160 for sealing with rotor 115. Similar seals are provided at the various stages of steam turbine 100 as illustrated and the direction of the steam flow path is indicated by the arrow 165.

Figure 2:
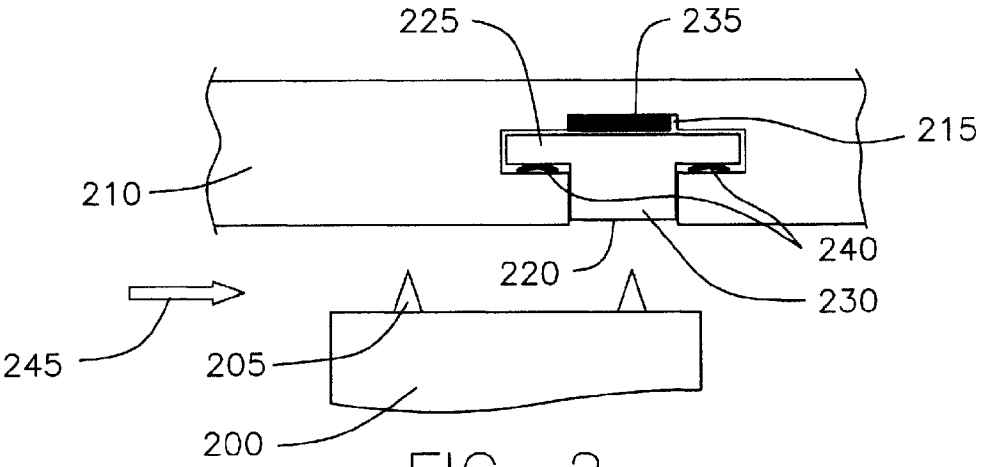
FIG. 2 is a schematic cross-sectional view of a gap closure device according to a first embodiment of the present invention.

FIG. 2 is a schematic cross-sectional view of a gap closure component according to a first embodiment of the present invention. FIG. 2, like FIGS. 3-8 show only portions of the rotary component and stationary component of the steam turbine depicted from FIG. 1 that are necessary to explain the operation of the various gap closure devices described herein. In particular, FIG. 2 shows a bucket tip and cover 200 with seal teeth 205 for the rotary component of the steam turbine and a diaphragm outer ring 210 with a groove 215 for the stationary component of the steam turbine.

The gap closure component of the embodiment shown in FIG. 2 includes a piston 220 placed in the groove 215 of the diaphragm outer ring 210. As shown in FIG. 2, piston 220 comprises a first portion 225 and a second portion 230. First portion 225 has a larger width than the width of second portion 230. The gap closure component of FIG. 2 also comprises a thermally-activated actuator 235 located in groove 215 of diaphragm outer ring 210 adjacent piston 220. The thermally-activated actuator 235 is located in groove 215 of diaphragm outer ring 210 adjacent first portion 225 of piston 220. The gap closure component of FIG. 2 also comprises a deactivator 240 located in the groove 215 of diaphragm outer ring 210 adjacent the piston 220. The deactivator 240 is located in groove 215 of the diaphragm outer ring 210 adjacent second portion 230 of piston 220.

In one embodiment of the invention, thermally-activated actuator 235 may comprise one more of any thermally-activated actuating element that can displace piston 220 from groove 215 in diaphragm outer ring 210 in a steam leakage path 245 of the steam turbine towards seal teeth 205 of bucket cover 200 in response to a temperature differential. A non-exhaustive list of possible thermally-activated actuating elements that are suitable for use in this application includes a bimetallic element that can take the form of a strip, a disk, a washer or other shapes. Although the thermally-activated actuator 235 is disclosed as a bimetallic element, those skilled in the art will recognize that other elements composed of materials with dissimilar thermal expansion properties can be used.

In one embodiment of the invention, deactivator 240 may comprise any return mechanism that can facilitate the return of piston 220 away from seal teeth 205 of bucket cover 200 towards diaphragm outer ring 210 as the turbine transitions from the steady-state operation to an inactive condition. A non-exhaustive list of possible elements that are suitable for use in this application as the deactivator includes spring elements and elastomeric elements. As shown in FIG. 2, deactivator 240 is a spring element. Those skilled in the art will recognize that a variety of different sizes and shapes of spring elements can be used to facilitate the return of piston 220 away from seal teeth 205 of bucket cover 200 towards outer diaphragm outer ring. Those skilled in the art will recognize that it is possible to even use one spring element as deactivator 240. Further, in another embodiment, it may be possible to have a gap closure component that does not utilize a spring element. In this embodiment, pistons in the bottom half of the turbine would not need a return mechanism because gravity would cause them to return to their initial position.

In FIG. 2, the steam turbine is an inactive state and thus diaphragm outer ring 210 is cold. When the steam turbine reaches its steady-state temperature, thermally-activated actuator 235 displaces piston 220 from diaphragm outer ring 210 towards seal teeth 205 of bucket cover 200 in response to the temperature differential in diaphragm outer ring 210.

Figure 3:
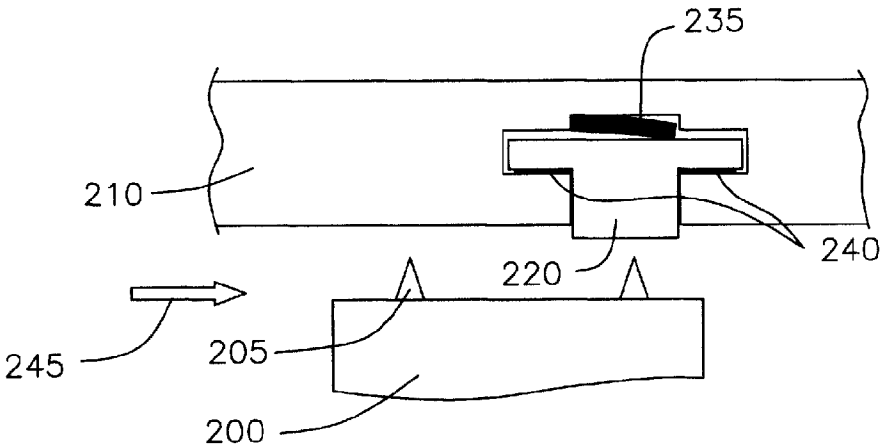
FIG. 3 is a schematic cross-sectional view showing the gap closure device of FIG. 2 in a thermally activated state in the presence of a temperature differential.

FIG. 3 shows the steam turbine in its steady-state mode of operation. That is, diaphragm outer ring 210 has reached its steady-state temperature, which causes thermally-activated actuator 235 to deform and displace piston 220, which causes an unbalancing of the spring load of the deactivator (i.e., spring elements) 240. This forces the piston 220 into the steam leakage path 245 out from the diaphragm outer ring 210 towards the seal teeth 205, closing the gap therebetween.

Figure 4:
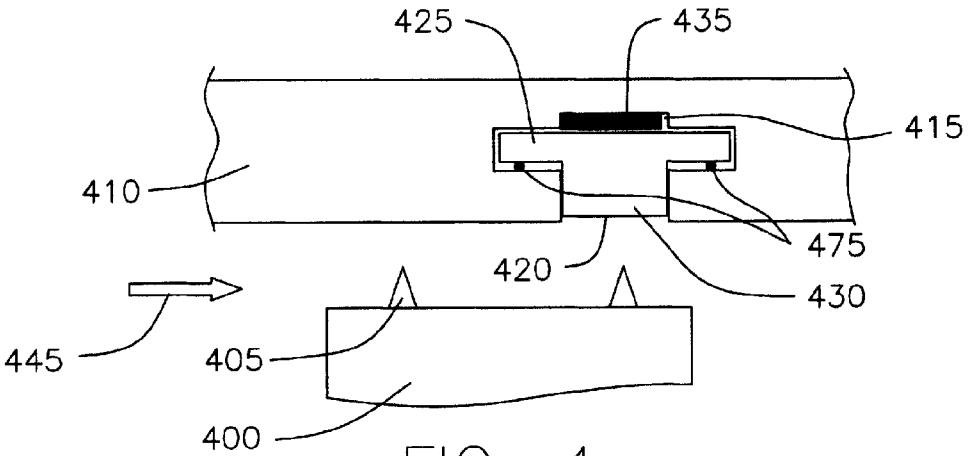
FIG. 4 is a schematic cross-sectional view of a gap closure device according to a second embodiment of the present invention.

FIG. 4 is a schematic cross-sectional view of a gap closure component according to a second embodiment of the present invention. Parts in FIG. 4 that are similar to parts used in FIGS. 2-3 are applied with like reference elements, except that the reference elements used in FIG. 4 are preceded with the numeral 4. In the embodiment of FIG. 4, elastomeric elements 475 are located in groove 415 of diaphragm outer ring 410 abutting first portion 425 of piston 420 and an upper portion of groove 415. As shown in FIG. 4, there are two elastomeric elements 475, each being on opposing sides of second portion 430 of piston 420 to balance the load of piston 420. Those skilled in the art will recognize that more than two elastomeric elements 475 may be used under each opposing side of second portion 430 of piston 420 or possibly only one elastomeric element may be used. Further, those skilled in the art will recognize that a variety of different sizes and shapes of elastomeric elements can be used to facilitate the return of piston 420 away from seal teeth 405 of bucket cover 400 towards diaphragm outer ring 410. For example, elastomeric elements may be solid or hollow. A non-exhaustive list of possible elastomeric materials that can be used for elastomeric elements 475 in lower temperature stages of the steam turbine include VITON (400 degrees Fahrenheit), which is a registered trademark of DuPont Dow Elastomers and SILASTIC (600 degrees Fahrenheit), which is a registered trademark of Dow Corning Corporation.

In FIG. 4, the steam turbine is an inactive state and thus the diaphragm outer ring 410 is cold. When the steam turbine reaches its steady-state temperature, thermally-activated actuator 435 displaces piston 420 from the diaphragm outer ring 410 towards seal teeth 405 of bucket cover 400 in response to the temperature differential in diaphragm outer ring 410.

Figure 5:
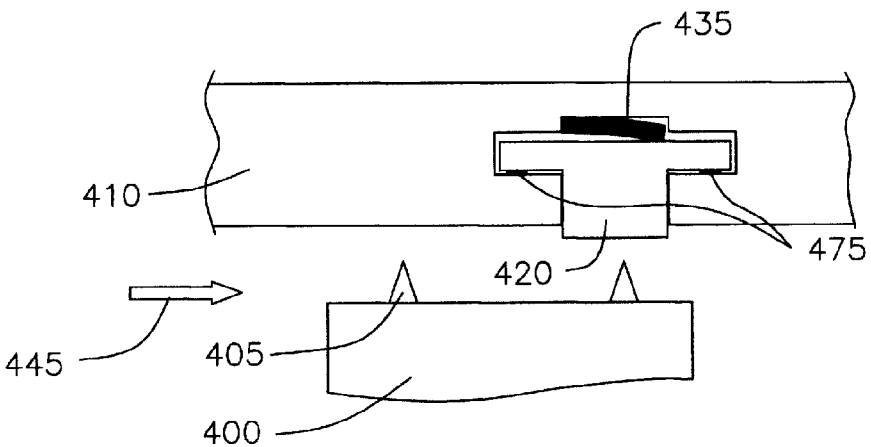
FIG. 5 is a schematic cross-sectional view showing the gap closure device of FIG. 4 in a thermally activated state in the presence of a temperature differential.

Like the embodiment depicted in FIGS. 2-3 in which spring elements are used as deactivator 240, a temperature change in diaphragm outer ring 410 will distort thermally-activated actuator 435, which unbalances the load on the elastomeric elements (i.e., deactivator 475) and forces piston 420 into a steam leakage path 445 (FIG. 4). FIG. 5 shows the steam turbine in its steady-state mode of operation. In particular, diaphragm outer ring 410 has reached its steady-state temperature, which causes thermally-activated actuator 435 to deform and displace piston 420, which causes an unbalancing of the load of deactivator (i.e., elastomeric elements) 475. This forces piston 420 into a steam leakage path 445 out from diaphragm outer ring 410 towards seal teeth 405, closing the gap therebetween. After the steam turbine has transitioned to a cold-state from a steady-state operation, thermally-activated actuator 435 deforms back to its original at rest position (i.e., inactive condition), resulting in piston 430 to move back into groove 415 of diaphragm outer ring 410 away from the steam leakage path 445 and seal teeth 405. In this rest position, elastomeric elements 475 are loaded to balance piston 430 in this position. As noted above for the embodiment that utilizes spring elements, it may be possible to have a gap closure component that does not utilize an elastomeric element. In this embodiment, the piston would rely on gravity to return to its initial position. In this case, gravity would return piston 430 to its original position in the lower half of the turbine.

Figure 6:
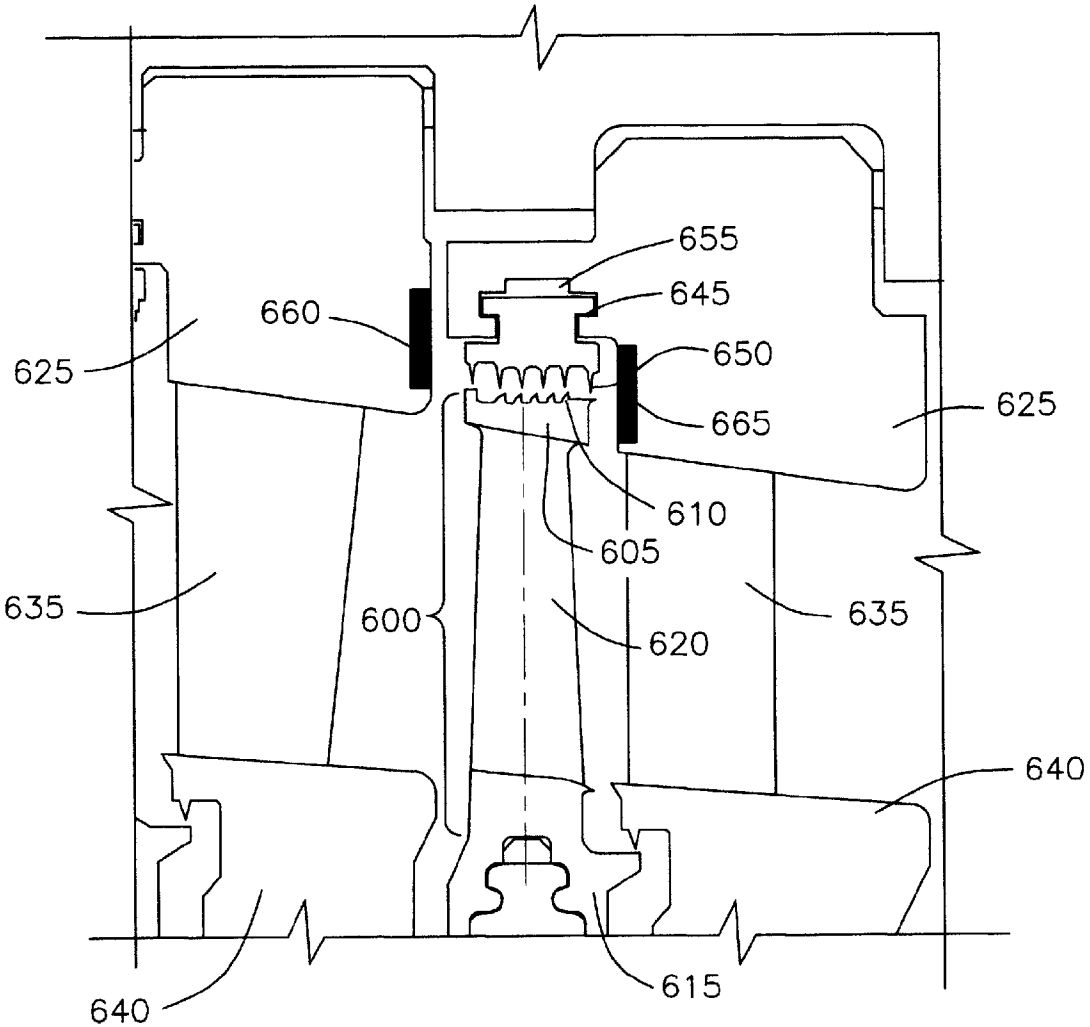
FIG. 6 is a schematic cross-sectional view of a gap closure device according to a third embodiment of the present invention.

FIG. 6 is a schematic cross-sectional view of a gap closure device according to a third embodiment of the present invention. FIG. 6 is similar to FIGS. 2-5 in that only a simplified illustration of a steam turbine is shown, however, FIG. 6 shows some more detail of the rotary and stationary components of a steam turbine. In particular, FIG. 6 shows a bucket 600 for the rotary component having a tip cover 605 with seal teeth 610, a dovetail 615 and an airfoil 620 between tip cover 605 and dovetail 615. The stationary component includes a diaphragm outer ring 625, mounting partitions 635 located between diaphragm outer ring 625 and a diaphragm inner ring 640. An additional element shown in the embodiment of FIG. 6 includes a seal carrier 645 having one or more seal teeth 650 located in a groove 655 of diaphragm outer ring 625. Seal carrier 645 is radial with respect to one or more seal teeth 610 of bucket cover 605. Seal carrier 645 serves to provide a seal of the seal path flowing through the rotary component and stationary component of the steam turbine.

In this embodiment, the gap closure component of the embodiment shown in FIG. 6 includes a first thermally-activated element 660 and a second thermally-activated element 665 located in groove 655 of diaphragm outer ring 625. First thermally-activated element 660 and second thermally-activated element 665 oppose each other and are located axial to seal teeth 610 of bucket cover 605 and seal teeth 650 of seal carrier 645. First thermally-activated element 660 and second thermally-activated element 665 moves towards seal teeth 610 of bucket cover 605 and seal teeth 650 of seal carrier 645 in response to a temperature differential in the steam turbine. In one embodiment, first thermally-activated element 660 and second thermally-activated element 665 comprise one or more thermally-activated elements that can include bimetallic strip(s). Those skilled in the art will recognize that other thermally-activated elements can be used such as elements composed of materials with dissimilar thermal expansion properties. Further in another embodiment, it may be possible to have a gap closure component that comprises only one thermally-activated element. Alternatively, it may be possible to use more than two thermally-activated elements that are shown in FIG. 6

In FIG. 6, the steam turbine is in an inactive state and thus diaphragm outer ring 625 are cold. When the steam turbine reaches its steady-state temperature, first thermally-activated element 660 and second thermally-activated element 665 move towards seal teeth 610 of bucket cover 605 and seal teeth 650 of seal carrier 645 in response to the temperature differential. In particular, first thermally-activated element 660 curves downstream of the steam leakage path and second thermally-activated element 665 curves upstream of the steam leakage path. Both first thermally-activated element 660 and second thermally-activated element 665 act to restrict steam leakage at the tip of bucket 600. After the steam turbine has transitioned to a cold-state from a steady-state operation, first thermally-activated element 660 and second thermally-activated element 665 deform back to their original at rest position (i.e., inactive condition). In particular, first thermally-activated element 660 curves back upstream of the steam flow path to its at rest position and second thermally-activated element 665 curves back downstream of the steam flow path to its at rest position.

Those skilled in the art will recognize that first thermally-activated element 660 and second thermally-activated element 665 can be used at other locations within the steam turbine to restrict leakage thereat. For example, first thermally-activated element 660 and second thermally-activated element 665 could be applied to restrict leakage at the inner root seal.

Figure 8:
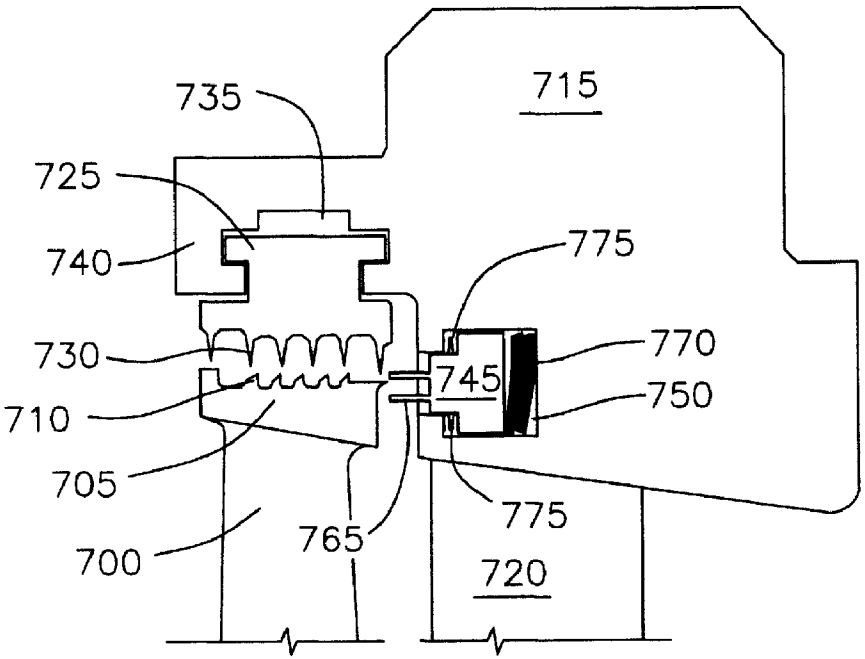
FIG. 8 is a schematic cross-sectional view showing the gap closure device of FIG. 7 in a thermally activated state in the presence of a temperature differential.
Figure 7:
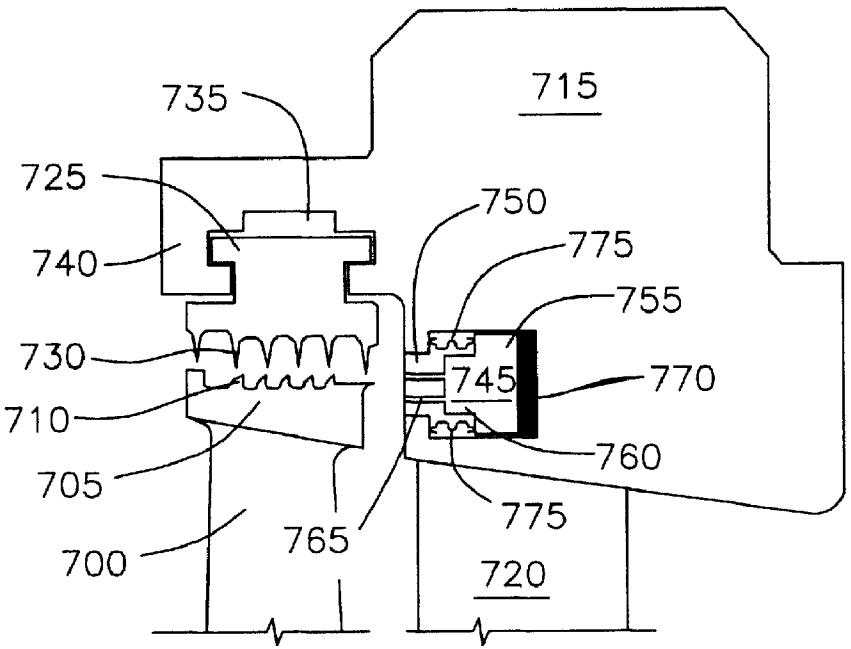
FIG. 7 is a schematic cross-sectional view of a gap closure device according to a fourth embodiment of the present invention.

FIGS. 7-8 are schematic cross-sectional views of a gap closure device according to a fourth embodiment of the present invention. FIGS. 7-8 are similar to FIG. 6 in that only a simplified illustration of a steam turbine is shown, however, FIGS. 7-8 show less detail of the rotary and stationary components of a steam turbine. In particular, FIGS. 7-8 show a bucket 700 having a tip cover 705 with seal teeth 710 for the rotary component and a diaphragm outer ring 715 and mounting partitions 720 for the stationary component. A seal carrier 725 having one or more seal teeth 730 is located in a groove 735 of an extension 740 of diaphragm outer ring 715.

The gap closure component of the embodiment shown in FIGS. 7-8 includes a piston 745 placed in a groove 750 of diaphragm outer ring 715 wherein the piston is axial to seal teeth 710 of bucket cover 705. Piston 745 has a first portion 755 and a second portion 760. First portion 755 has a larger width than the width of second portion 760. Further, second portion 760 has seal teeth 765 projecting axially outward therefrom. Seal teeth 765 project axially outward from second portion 760 of piston 745 and are forced in the steam leakage path from diaphragm outer ring 715 towards seal teeth 710 of bucket cover 705 in response to a temperature differential.

FIGS. 7-8 further show that the gap closure component of this embodiment comprises a thermally-activated actuator 770 located in groove 750 of diaphragm outer ring 715 adjacent piston 745. Thermally-activated actuator 770 is located in 750 groove of diaphragm outer ring 715 adjacent first portion 755 of piston 745. Thermally-activated actuator 770 displaces piston 745 from diaphragm outer ring 715 in the steam leakage path towards seal teeth 710 of bucket cover 705 in response to a temperature differential. Like previous embodiments, thermally-activated actuator 770 may include a bimetallic element that can take the form of a strip, a disk, a washer or other shapes. Similarly, other elements composed of materials with dissimilar thermal expansion properties can be used.

FIGS. 7-8 further show that the gap closure component of this embodiment comprises a deactivator 775 located in groove 750 of diaphragm outer ring 715 adjacent piston 745. In particular, deactivator 775 is located in groove 750 of diaphragm outer ring 715 adjacent second portion 760 of piston 745. Deactivator 775 returns piston 745 from the steam leakage path away from seal teeth 710 of bucket cover 705 towards diaphragm outer ring 715 as the turbine transitions from the steady-state operation to the inactive condition. As shown in FIGS. 7-8, deactivator 775 comprises spring elements, however, those skilled in the art will recognize that other elements can be used to balance the load of piston 745 such as elastomeric elements shown in the embodiment of FIGS. 4-5. As noted above for the embodiment, it may be possible to not utilize deactivator 775 (e.g., spring elements, elastomeric elements). In this embodiment, piston 745 will remain in its activated position until it comes into contact with the rotor, which will cause a light rub and push piston 745 back to its initial position.

In FIG. 7, the steam turbine is an inactive state and thus the diaphragm outer ring 715 is cold. When the steam turbine reaches its steady-state temperature, thermally-activated actuator 770 displaces piston 745 and at least one seal tooth 765 from diaphragm outer ring 715 towards seal teeth 710 of bucket cover 705 in response to the temperature differential in outer diaphragm 715. FIG. 8 shows the steam turbine in its steady-state mode of operation where thermally-activated actuator 770 deforms and displaces piston 745, which causes an unbalancing of the spring load of deactivator (i.e., spring elements) 775. This forces piston 745 and its seal teeth 765 into the steam leakage path out from the diaphragm outer ring 715 towards seal teeth 710. Although this embodiment is described with reference to using seal teeth 765 with piston 745, those skilled in the art will recognize that this embodiment can work with piston 745 having only a single seal tooth, or without any seal teeth.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A steam turbine, comprising:

a rotary component including a plurality of circumferentially spaced buckets that are spaced at axial positions, each of the plurality of spaced buckets having a tip with an adjacent cover that includes one or more seal teeth;

a stationary component including a plurality of diaphragms each having a diaphragm outer ring, the plurality of diaphragms are axially positioned between adjacent rows of the plurality of spaced buckets, each row forms a turbine stage that defines a portion of a steam flow path through the steam turbine, each diaphragm outer ring having at least one groove formed therein; and a gap closure component located about the rotary component and the stationary component seals a portion of a steam leakage path, the gap closure component including a plurality of gap closure devices, each of the plurality of gap closure devices located in the at least one groove of a respective diaphragm outer ring and about the one or more seal teeth of a respective bucket cover in a turbine stage, each of the plurality of gap closure devices activated by a temperature differential formed in the diaphragm outer ring as the turbine transitions from an inactive condition to a steady-state operation, each of the plurality of gap closure devices providing a seal of the steam leakage path through the one or more seal teeth of a bucket cover and the diaphragm outer ring in response to being activated.

2. The steam turbine according to claim 1, wherein each of the plurality of gap closure devices comprises a thermally-activated actuator that displaces the gap closure device in the steam leakage path from the diaphragm outer ring towards the one or more seal teeth of the bucket cover in response to the temperature differential.

3. The steam turbine according to claim 2, wherein the thermally-activated actuator includes at least one bimetallic element.

4. The steam turbine according to claim 1, wherein each of the plurality of gap closure devices comprises a deactivator that returns the gap closure device to an inactive position as the turbine transitions from the steady-state operation to the inactive condition.

5. The steam turbine according to claim 4, wherein the deactivator is selected from the group consisting of at least one spring element and at least one elastomeric element.

6. The steam turbine according to claim 1, wherein each of the plurality of gap closure devices comprises a piston placed in the groove of the diaphragm outer ring, the piston forced in the steam leakage path from the diaphragm outer ring towards the one or more seal teeth of the bucket cover in response to the temperature differential, the piston having a first portion and a second portion, the first portion having a larger width than the width of the second portion.

7. The steam turbine according to claim 6, wherein each of the plurality of gap closure devices comprises a thermally-activated actuator located in the groove of the diaphragm outer ring adjacent the piston, the thermally-activated actuator located in the groove of the diaphragm outer ring adjacent the first portion of the piston, the thermally-activated actuator displaces the piston from the diaphragm outer ring in the steam leakage path towards the one or more seal teeth of the bucket cover in response to the temperature differential.

8. The steam turbine according to claim 7, wherein the thermally-activated actuator includes at least one bimetallic element.

9. The steam turbine according to claim 6, wherein each of the plurality of gap closure devices comprises a deactivator located in the groove of the diaphragm outer ring adjacent the piston, the deactivator located in the groove of the diaphragm outer ring adjacent the second portion of the piston, the deactivator returning the piston from the steam leakage path away from the one or more seal teeth of the bucket cover towards the diaphragm outer ring as the turbine transitions from the steady-state operation to the inactive condition.

10. The steam turbine according to claim 9, wherein the deactivator is selected from the group consisting of at least one spring element and at least one elastomeric element.

11. The steam turbine according to claim 1, wherein each of the plurality of gap closure devices are located in the groove of the diaphragm outer ring, axial to the one or more seal teeth of the bucket cover.

12. The steam turbine according to claim 11, wherein each of the plurality of gap closure devices comprises a first thermally-activated element that moves towards the one or more seal teeth of the bucket cover in response to the temperature differential.

13. The steam turbine according to claim 12, wherein each of the plurality of gap closure devices further comprises a second thermally-activated element opposite from the first thermally-activated element, the second thermally-activated element moves towards the one or more seal teeth of the bucket cover in response to the temperature differential.

14. The steam turbine according to claim 13, wherein the first and second thermally-activated elements includes at least one bimetallic element or elements of dissimilar thermal expansion.

15. The steam turbine according to claim 1, wherein each of the plurality of gap closure devices comprises a piston placed in the groove of the diaphragm outer ring wherein the piston is axial to the one or more seal teeth of the bucket cover, the piston having a first portion and a second portion, the first portion having a larger width than the width of the second portion, the second portion having more than one seal teeth projecting axially outward therefrom, the one or more seal teeth projecting axially outward from the second portion of the piston forced in the steam leakage path from the diaphragm outer ring towards the one or more seal teeth of the bucket cover.

16. The steam turbine according to claim 15, wherein each of the plurality of gap closure devices comprises a thermally-activated actuator located in the groove of the diaphragm outer ring adjacent the piston, the thermally-activated actuator located in the groove of the diaphragm outer ring adjacent the first portion of the piston, the thermally-activated actuator displaces the piston from the diaphragm outer ring in the steam leakage path towards the one or more seal teeth of the bucket cover in response to the temperature differential formed in the diaphragm outer ring as the turbine transitions from an inactive condition to a steady-state operation.

17. The steam turbine according to claim 16, wherein the thermally-activated actuator includes at least one bimetallic element or elements of dissimilar thermal expansion.

18. The steam turbine according to claim 15, wherein each of the plurality of gap closure devices comprises a deactivator located in the groove of the diaphragm outer ring adjacent the piston, the deactivator located in the groove of the diaphragm outer ring adjacent the second portion of the piston, the deactivator returning the piston from the steam leakage path away from the one or more seal teeth of the bucket cover towards the diaphragm outer ring as the turbine transitions from the steady-state operation to the inactive condition.

19. The steam turbine according to claim 18, wherein the deactivator is selected from the group consisting of at least one spring element and at least one elastomeric element.

20. The steam turbine according to claim 1, wherein each diaphragm outer ring comprises a seal carrier having one or more seal teeth located in a groove of an extension of the diaphragm outer ring that is radial with respect to the one or more seal teeth of the bucket cover.

* * * * *